US006328439B1

(12) United States Patent
Rhodes

(10) Patent No.: US 6,328,439 B1
(45) Date of Patent: Dec. 11, 2001

(54) HEATED VACUUM BELT PERFORATION PATTERN

(75) Inventor: John D Rhodes, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/479,038

(22) Filed: Jan. 7, 2000

(51) Int. Cl.[7] ..... B41J 2/01
(52) U.S. Cl. ..... 347/102
(58) Field of Search ..... 347/102, 101; 271/264, 275, 198

(56) References Cited

U.S. PATENT DOCUMENTS

| | | | | |
|---|---|---|---|---|
| 3,617,127 | | 11/1971 | McDuff | 355/73 |
| 4,145,040 | | 3/1979 | Huber | 271/276 |
| 5,342,133 | | 8/1994 | Canfield | 400/635 |
| 5,371,531 | * | 12/1994 | Rezanka et al. | 347/43 |
| 5,510,822 | | 4/1996 | Vincent et al. | 347/102 |
| 5,717,446 | * | 2/1998 | Teumer et al. | 347/35 |
| 6,168,269 | * | 1/2001 | Rasmussen et al. | 347/101 |

* cited by examiner

*Primary Examiner*—John Barlow
*Assistant Examiner*—Michael S Brooke

(57) ABSTRACT

An endless loop belt for a hard copy apparatus includes a thermally conductive material belt body having an outer surface for receiving print media thereon. The belt body has a pattern of apertures therethrough such that a vacuum force applied to an inner surface is transmitted through the apertures to the outer surface such that a superjacently positioned sheet of print media adheres to the belt. The pattern has a predetermined stagger of apertures which are elongated in a paper path direction wherein transverse expansion of the belt body is accommodated such that the distortion is substantially eliminated in heated regions of the belt body.

14 Claims, 1 Drawing Sheet

HEATED VACUUM BELT PERFORATION PATTERN

BACKGROUND OF THE INVENTION

1. Field of the Invention

This invention relates generally to print media handling systems and, more particularly, to an endless-loop, vacuum belt, media transport for a hard copy apparatus.

2. Description of Related Art

Automated business machines for producing or reproducing hard copy documents, such as copiers, printers, facsimile machines, document scanners, and the like, are well known commercially.

Ideally, when working with cut sheet printing media (hereinafter also referred to generically as "paper") for a multiple page document, a hard copy device will automatically feed a single sheet of paper and, when operation is finished on the one sheet, e.g., printing a page with ink-jet pens, it is off-loaded while another sheet immediately follows. A continuous flow of paper sheets by automated feeding and positioning without the necessity of manual handling reduces the time required to accomplish the complete operation. The more quickly and accurately the sheet feeding, the faster the operation can be completed, e.g., scanning a multi-page document into a host computer memory. The mechanisms for media sheet feeding are commonly referred to in the art as an automatic document feeder or "ADF."

Belt type document feeders have been adapted to place a document onto a glass scanning bed. One such exemplary system is shown in U.S. Pat. No. 5,342,133 (Canfield), assigned to the common assignee of the present invention. In co-pending U.S. patent application Ser. No. 09/163,098, filed Sep. 29, 1998 by S. O. Rasmussen et al., for a BELT DRIVEN MEDIA HANDLING SYSTEM WITH FEEDBACK CONTROL FOR IMPROVING MEDIA ADVANCE ACCURACY (assignors to the common assignee herein and incorporated herein by reference), a media handling system has an endless belt having a gripping surface which carries a media sheet through a print zone. Improved media advance accuracy is achieved by including closed loop feedback control.

It has also been a long known commercial practice to use a vacuum force distributed across a surface as a holddown. See e.g., U.S. Pat. No. 3,617,127 (1971) to McDuff for a PHOTOGRAPHIC MATERIAL TRANSPORT WITH VACUUM PLATEN. Paper handling vacuum drums have also been commonly practiced. See e.g., U.S. Pat. No. 4,145,040 (first filed in Switzerland in 1975) to Huber for a GRIPPER DRUM.

There are many attendant problems to the use of vacuum platens for printing operations, whether planar type, drum type or endless belt type. In an ink-jet hard copy apparatus (commercial products such as computer printers, graphics plotters, copiers, and facsimile machines employing ink-jet technology for producing hard copy are well-known; the basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions, or as described by W. J. Lloyd and H. T. Taub in *Output Hardcopy* [*sic*] *Devices,* chapter 13 (Ed. R. C. Durbeck and S. Sherr, Academic Press, San Diego, 1988))—hereinafter simply referred to as "printers"—one such problem is the need for maintaining the media as flat as possible, not only to render the highest quality print, but also because of the interaction of the wet ink with the paper. "Ink" generally can be dye-based or pigment-based and uses water or another evaporative solvent as a carrier. When an image to be recorded has high density, a large amount of water is applied to and driven into the medium which in turn swells erratically, causing the printed regions to become wavy, a phenomenon generally known as cockling. To minimize cockle, ink-jet printers sometimes employ heaters. For example, in U.S. Pat. No. 5,510,822 for an INK-JET PRINTER WITH HEATED PRINT ZONE by Vincent et al. (assigned to the common assignee of the present invention and incorporated herein by reference), a printer includes a platen heater assembly as a means of fixing and drying the ink on the paper and a vacuum fan and associated plurality of platen vacuum holds as a means of holding the paper in close contact with the heater plate assembly.

One problem associated with the use of a combination of endless belt and a heater is that distortion of the belt itself occurs because the belt material simultaneously expands in the heated region but is constrained from expanding by adjacent regions. Thus, a belt will distort locally and ripple, which closely resembles the phenomenon of cockling of the paper, a phenomenon sometimes referred to as "potato chipping." The belt ripples interfere with thermal transfer from the heater to the paper and with maintaining the paper flat with respect to the ink-jet writing instruments. The net effects are poor thermal efficiency, print artifacts due to misplaced drops of ink, and uneven drying of the paper with resultant cockle.

Therefore, there is a need for means to eliminate heat-induced distortion of a paper transport belt.

SUMMARY OF THE INVENTION

In its basic aspects, the present invention provides an endless-loop belt for a hard copy apparatus, including: a thermally conductive material belt body having an outer surface for receiving print media thereon, the belt body having a pattern of apertures therethrough such that a vacuum force applied to an inner surface of the belt body is transmitted through the apertures, and the pattern having a predetermined stagger of apertures wherein the apertures are elongated in a paper path direction and wherein transverse expansion of the belt body is accommodated such that heat-induced distortion is substantially eliminated in the belt body.

In another basic aspect, the present invention provides an ink-jet hard copy apparatus including: writing instrument mechanisms for firing ink drops onto a portion of adjacently positioned print media located within a print zone of the apparatus; selectively movable, thermally conductive, endless-loop, at least one vacuum belt for transporting the print media through the print zone, the belt having an outer surface upon which the media is adhered to by a vacuum force as the media passes through the print zone; and heater mechanisms for applying heat to the belt at the print zone, the belt having a pattern having a predetermined stagger of apertures wherein the apertures are elongated in a paper path direction and wherein transverse expansion due to heating of the belt is accommodated such that the distortion is substantially eliminated in the belt.

In another basic aspect, the present invention provides a method for preventing thermal buckling of a heated, endless loop, print media, transport belt. The method includes the steps of: fabricating an endless loop belt of a material having a thermal coefficient in an approximate range of $9\times10^{-6}/°$ C. to $24\times10^{-6}/°$ C.; and perforating the belt with vacuum ports having a pattern such that the pattern having a predetermined stagger of apertures wherein the apertures are elongated in a paper path direction and wherein transverse expansion of the belt is accommodated such that the distortion is substantially eliminated in the belt.

Some of the advantages of the present invention are:

- it provides a solution to aforementioned problems;
- it provides a heated vacuum belt construct useful in the transport of flexible sheet material;
- it provides a heated vacuum belt paper transport useful in ink-jet printing; and
- it provides a heated vacuum belt paper transport that maintains planarity of a transports sheet during ink-jet printing operations.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P 608.01 (d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

Figure 1:
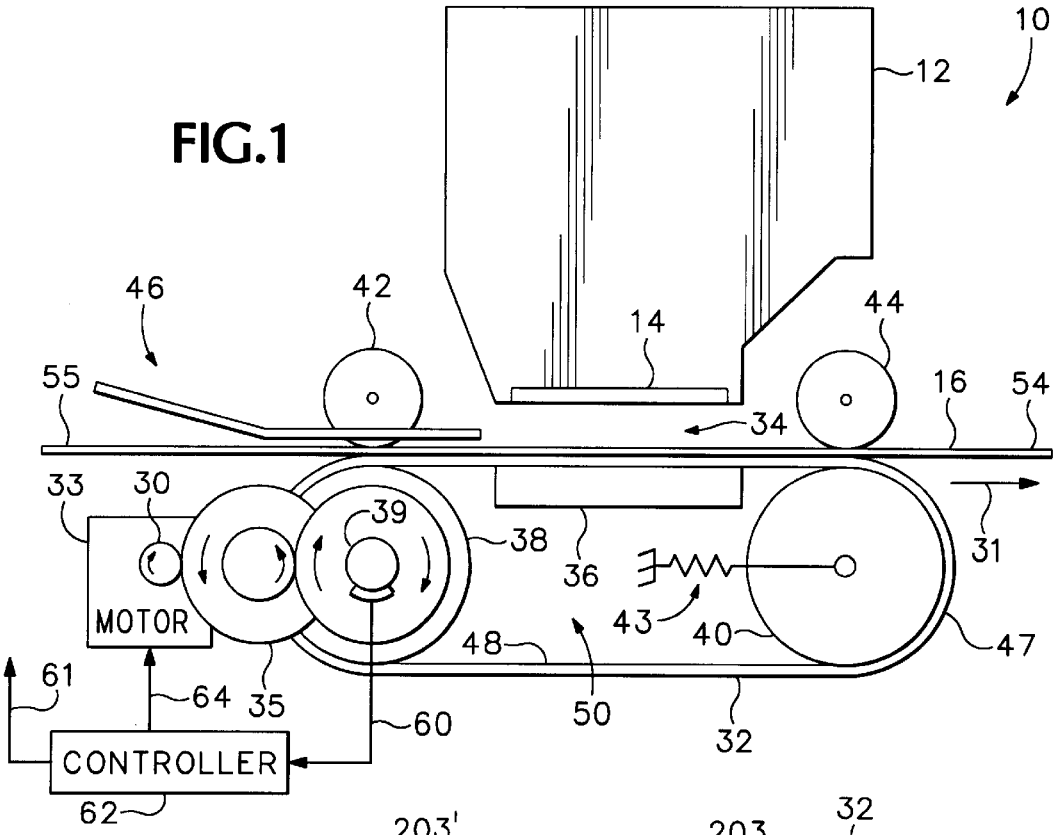
FIG. 1 is an ink-jet hard copy apparatus according to an embodiment of the present invention.

FIG. 1 is an ink-jet hard copy apparatus 10 according to an exemplary embodiment of the present invention. The apparatus 10 includes an ink-jet pen 12 having a printhead 14. The printhead 14 includes a plurality of known manner ink drop generators, including ink-jet nozzles which eject ink onto a sheet of paper 16 adjacently positioned in a "print zone" 34 of the apparatus 10. The paper sheet 16 is moved along a paper path, represented by arrow 31. Over a portion of the paper path 31, including through the print zone 34, the sheet 16 is carried by an endless loop belt 32. Within the print zone 34, a heated platen 36 maintains the belt 32 in a fixed orientation, so as to maintain a desired pen-to-paper spacing. Note that a separate heater also, or alternatively, may be mounted upstream or downstream of the print zone 34 and be separate from the platen 36. The belt 32 runs in an endless-loop about a drive roller 38 and an idler roller 40. One or more drive rollers 38 are mounted to a drive shaft 39. The drive shaft 39 is rotated by a drive motor 33 through a gear train 30, 35, causing the belt 32 to move along the rollers 38, 40 in the endless-loop manner. The idler roller 40 is spring-loaded 43 to maintain the belt 32 at a desired tension. The spring-loading of idler roller 40 serves to maintain a desired belt tension even in the presence of some belt stretching. The apparatus 10 includes a paper path upstream pinch roller 42, an optional downstream pinch roller 44, and a paper guide 46. The upstream pinch roller 42 presses the sheet 16 to an outer surface 47 of the belt 32 in an area between the upstream pinch roller 42 and the drive roller 38 for loading the sheet 16 via its leading edge 54 onto the belt 32. The downstream pinch roller 44, if present, presses the sheet 16 to an outer surface 47 of the belt in an area between the downstream pinch roller 44 and the idler roller 40 for off-loading the sheet 16 via its trailing edge 55 from the belt 32. Between the pinch rollers 42, 44, the sheet is adhered to the belt 32 by a known manner vacuum force through the cavity 50 formed by the belt (or by a known manner vacuum box platen or the like) and a holding suction is exerted on the underside of the sheet 16 through perforations in the belt 32. The guide 46 extends from approximately the upstream pinch roller 42 toward an area of the outer surface 47 of the belt 32 where the vacuum force applied across an inner surface 48 will be exerted through the belt and take over maintaining the sheet 16 on the outer surface 47 of the belt 32 in the paper path through the print zone 34. Operations are implemented by an electronic controller 62 (usually a microprocessor or application specific integrated circuit ("ASIC") controlled printed circuit board connected by appropriate cabling 60, 64 and an electrical interface 61 to other apparatus electromechanical subsystems, such as pen 12, and, in computer peripheral printers, by an input-output port to the computer (not shown). It is well known to program and execute imaging, printing, print media handling, control functions, and logic with firmware or software instructions for conventional or general purpose microprocessors or ASIC's.

In the preferred embodiment, the belt 32 is fabricated of a material which is relatively stiff so as to prevent substantial stretching over time. In the preferred embodiment, the belt 32 is made of 300-Series or 400-Series stainless steel, which is commercially available from U.S. Steel Corporation. Other belt materials, such as synthetic organics or textiles, may also be employed in accordance with the present invention. In the preferred embodiment, the coefficient of thermal expansion is in the approximate range of $9\times10^{-6}/°$ C. to $24\times10^{-6}/°$ C.

Figure 2A:
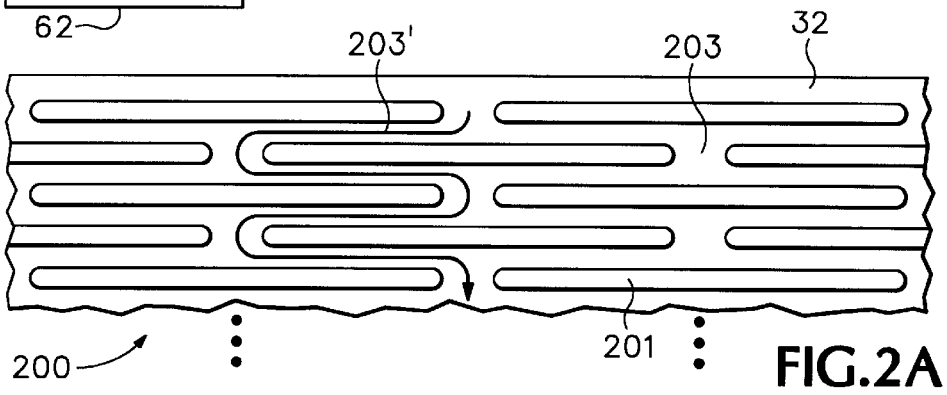
FIGS. 2A and 2B are sectional planar detail illustrations of alternative belt elements of the present invention as shown in FIG. 1.
Figure 2B:
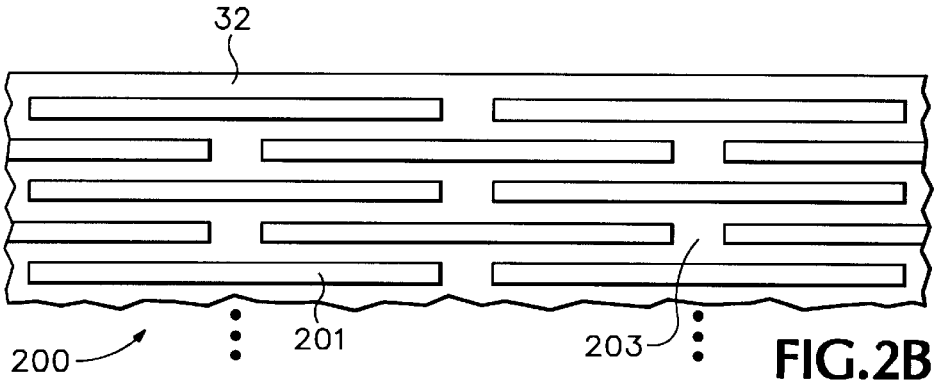

FIGS. 2A and 2B illustrate alternative embodiments for a detail section of the belt 32 of FIG. 1. When heated, distortion in the heated region of the belt occurs because the heated region expands while simultaneously being constrained from expanding by the adjacent cool regions. As the preferred apparatus materials and geometry exhibit a low thermal mass, rapid heating and cooling occurs at transition regions of belt 32 proximate the heating element. Axial expansion is absorbed by the belt tension mechanism comprising the spring loaded roller 40, but cross paper path, or transverse, expansion is constrained and the "potato chipping" occurs at the interface between the hot and cool regions of the belt.

By perforating the belt 32 in a pattern 200 of predetermined stagger of elongated apertures 201, transverse expansion is accommodated such that the distortion is substantially eliminated. The remaining belt material 203 is connected in a serpentine construct illustrated by arrow 203'.

This readily absorbs the transverse expansion caused by the heated platen 36 (FIG. 1) subjacent the belt 32 in the print zone 34, It has been found that less compliance is achieved the closer the apertures come to approximating a circle. Therefore, oblong or rectangular shapes are preferred. It has been found that apertures having a length at least three times the width are preferable.

In an exemplary embodiment, an approximately 0.004-inch thick, stainless steel, belt 32 has a length of about twenty inches, with a span length—i.e., between the rollers—of approximately seven inches. The belt width is approximately nine inches. Each aperture is approximately 0.20-inch long in the direction of the paper path 31 and has a transverse dimension of approximately 0.012-inch. The "offset" of apertures is approximately 0.025-inch, or 12% of the aperture length. This demonstrated exemplary pattern 200 allows the belt to retain appropriate stiffness in the paper path 31 axial direction and enables accurate control of line-feed advance through the print zone 34.

It is also to be noted that a non-symmetrical pattern can be designed for a specific implementation of the present invention to improve thermal expansion compliance in the transverse axis.

The foregoing description of the preferred embodiment of the present invention has been presented for purposes of illustration and descriptions It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraphs unless the element is expressly recited using the phrase "means for . . . ".

What is claimed is:

1. An endless-loop belt for a hard copy apparatus, comprising:

a thermally conductive material belt body having an outer surface for receiving print media thereon, the belt body having a pattern of apertures therethrough such that a vacuum force applied to an inner surface of the belt body is transmitted through the apertures, and the pattern having a predetermined stagger of apertures wherein the apertures are elongated and axially aligned longitudinally in a paper path direction and wherein transverse expansion of the belt body is accommodated such that heat-induced distortion is substantially eliminated in the belt body.

2. The belt as set forth in claim 1 in a hard copy apparatus having a heated platen device wherein the pattern has a predetermined geometry such heat-induced belt distortion during traverse of the platen device is substantially eliminated.

3. The belt as set forth in claim 1 comprising:

belt material between the apertures has a pattern wherein the material is integrated into a serpentine construct.

4. The belt as set forth in claim 1 comprising:

the belt body is formed of a material having a thermal coefficient in an approximate range of $9\times10^{-6}/°$ C. to $24\times10^{-6}/°$ C.

5. The belt as set forth in claim 1 comprising:

the belt body is formed of a material selected from the group consisting of stainless steel, synthetic organic compounds, or textiles.

6. An ink-jet hard copy apparatus comprising:

writing instrument means for firing ink drops onto a portion of adjacently positioned print media located within a print zone of the apparatus;

selectively movable, thermally conductive, endless-loop, vacuum belt means for transporting the print media through the print zone, the belt means having an outer surface upon which the media is adhered to by a vacuum force as the media passes through the print zone; and heater means for applying heat to the belt means at the print zone, the belt means having a pattern having a predetermined stagger of apertures wherein the apertures are elongated and axially aligned longitudinally in a paper path direction and wherein transverse expansion due to heating of the belt means is accommodated such that the distortion is substantially eliminated in the belt means.

7. The belt as set forth in claim 6 comprising:

remaining belt material between the apertures is connected in a serpentine construct.

8. The belt as set forth in claim 6 comprising:

the belt body is formed of a material having a thermal coefficient in an approximate range of $9\times10^{-6}/°$ C. to $24\times10^{-6}/°$ C.

9. The belt as set forth in claim 6 comprising:

the belt body is formed of a material selected from the group consisting of stainless steel, a synthetic organic material, synthetic organic compounds, or a textile material.

10. A method for preventing thermal buckling of a heated, endless loop, print media, transport belt, comprising the steps of:

fabricating an endless loop belt of a material having a thermal coefficient in an approximate range of $9\times10^{-6}/°$ C. to $24\times10^{-6}/°$ C.; and perforating the belt with vacuum ports having a pattern such that the pattern having a predetermined stagger of apertures wherein the apertures are elongated and axially aligned longitudinally in a paper path direction and wherein transverse expansion of the belt is accommodated such that the distortion is substantially eliminated in the belt.

11. The method as set forth in claim 10, further comprising the step of:

providing a belt aperture pattern in an axis transverse to a longitudinal axis of said paper path direction such that thermal expansion is substantially eliminated in said axis transverse to a longitudinal axis.

12. The method as set forth in claim 10, further comprising the step of:

providing a belt aperture pattern such that transition regions of heated and non-heated regions of the belt are accommodated wherein buckling of the belt material is substantially eliminated.

13. The method as set forth in claim 10, the step of perforating further comprising:

forming apertures that have a y-axis dimension at least three times the x-axis dimension, wherein said y-axis is said paper path axis and said x-axis is said transverse axis.

14. The method as set forth in claim 10, the step of perforating further comprising:

providing an aperture pattern wherein transversely adjacent apertures are offset from each other along the longitudinal axis by approximately twelve percent of aperture length.

* * * * *